US006173648B1

(12) United States Patent
Misono et al.

(10) Patent No.: US 6,173,648 B1
(45) Date of Patent: Jan. 16, 2001

(54) MANUFACTURING METHOD OF LIQUID CRYSTAL DISPLAY ELEMENT AND MANUFACTURING APPARATUS OF THE SAME

(75) Inventors: Kenji Misono, Nara; Makoto Iwamoto, Ikoma; Thoru Sakuwa, Nara; Hiroyuki Nagano, Yamatokoriyama; Kenji Nishida, Otsu, all of (JP)

(73) Assignee: Sharp Kabushiki Kaisha, Osaka (JP)

( * ) Notice: Under 35 U.S.C. 154(b), the term of this patent shall be extended for 0 days.

(21) Appl. No.: 09/150,735

(22) Filed: Sep. 10, 1998

(30) Foreign Application Priority Data

Oct. 24, 1997 (JP) ..... 9-292111
Jun. 24, 1998 (JP) ..... 10-176767

(51) Int. Cl.[7] ..... B25B 11/00
(52) U.S. Cl. ..... 101/474; 269/21; 248/362
(58) Field of Search ..... 101/41, 43, 44, 101/126, 163, 474, 475, 485, 486; 269/21; 248/362, 363, 500

(56) References Cited

U.S. PATENT DOCUMENTS 2,717,756 * 9/1955 Keeshan et al. ..... 248/363
4,468,017 * 8/1984 Pavone ..... 269/21
4,721,462 * 1/1988 Collins, Jr. ..... 248/362
5,707,051 * 1/1998 Tsuji ..... 269/21
5,760,864 * 6/1998 Yamada et al. ..... 269/21
5,857,667 * 1/1999 Lee ..... 269/21
5,987,729 * 11/1999 Moran ..... 269/21

FOREIGN PATENT DOCUMENTS

80141 * 7/1981 (JP) ..... 269/21
303720 * 12/1989 (JP) ..... 269/21
736 * 1/1994 (JP) ..... 269/21
07033281 2/1995 (JP) .
8-8304777 11/1996 (JP) .
08324786 12/1996 (JP) .
09080404 3/1997 (JP) .
92/10336 * 6/1992 (WO) ..... 269/21

* cited by examiner

*Primary Examiner*—Stephen R. Funk
(74) *Attorney, Agent, or Firm*—Nixon & Vanderhye P.C.

(57) ABSTRACT

Manufacturing methods of liquid crystal display elements and manufacturing apparatuses for same which prevent an insulating substrate from sliding out of position and which attract and fix the substrate firmly and flatly by removing deformations of the substrate with substantially strong forces, even when a thin-type glass substrate or a thin-type plastic substrate is employed. A blower is used to exert attractive forces on the insulating substrate placed on a stage at a second attraction opening. A vacuum pump and a switching valve are used to exert the attractive forces first at the first attraction openings of the first group, then at the first attraction openings of the first and second groups, and finally at the first attraction openings of the first, second, and third groups on nearly the entire insulating substrate.

9 Claims, 5 Drawing Sheets

MANUFACTURING METHOD OF LIQUID CRYSTAL DISPLAY ELEMENT AND MANUFACTURING APPARATUS OF THE SAME

FIELD OF THE INVENTION

The present invention relates to manufacturing methods of liquid crystal display elements used in a liquid crystal display element manufacturing process and manufacturing apparatuses of the same, and in particular to a resist applying apparatus, an exposure apparatus, a rubbing apparatus, a spacer dispersion apparatus, a seal printing apparatus, and the like.

BACKGROUND OF THE INVENTION

Conventional liquid crystal display elements include a glass substrate typically having dimensions of about 300 mm×400 mm×0.7 mm. Recent liquid crystal display elements include a larger glass substrate of a 400 mm or 500 mm size.

In a manufacturing process of such liquid crystal display elements, the glass substrate is moved past, for example, a resist applying apparatus, an exposure apparatus, an orientation film printing apparatus, a spacer dispersion apparatus, a seal printing apparatus, and the like. During operation by the apparatus, the glass substrate 51 is fixed onto a flat upper surface of a support table (hereinafter will be referred to as a stage) 52 by vacuum attraction as shown in FIGS. 6 and 7.

Specifically, the stage 52 has attraction openings 53 having a diameter of about 0.5 mm to 1.0 mm arrayed in a matrix form with intervals of about 5 mm to 30 mm. The attraction openings 53 are connected via a linking passage 54 to a vacuum pump 55 disposed underneath the stage 52. The glass substrate 51 is attracted by vacuum attractive forces exerted simultaneously across nearly the entire glass substrate 51 at the attraction openings 53, and thus fixed onto the stage 52.

The glass substrate 51, made to be like a flat panel with superb flatness and rigidity, dose not warp and is fixed onto the stage 52 uniformly even if attractive forces are exerted in a discrete manner thereonto at the attraction openings 53 simultaneously as explained above. As a result, for example, in the orientation film printing treatment of the manufacturing process of a liquid crystal display element, an orientation film is uniformly applied with no printing irregularities such as convexities and concavities in the finished state.

Moreover, as disclosed in Japanese Laid-Open Patent Application No. 9-80404/1997 (Tokukaihei 9-80404), a slightly bent glass substrate 51 having a thickness of about 0.7 mm can be attracted without vacuum breakdown by vacuuming several regions with time shifts using a vacuum pump and a switching valve because of the weight of the glass substrate 51 itself.

The glass substrate 51 is disposed on the stage 52 by being positioned properly in a cassette loaded with a plurality of glass substrates 51 by means of positioning pins and the like and then placed on lift pins standing on the stage 52 by a transport arm and the like.

The glass substrate 51 is then placed on the stage 52 by lowering the lift pins and fixed onto the stage 52 by exerting vacuum attractive forces at the attraction openings 53 either simultaneously or with time shifts using the switching valve and the like as described above.

Thereafter, for example, in an orientation film printing apparatus and a seal printing apparatus, highly precise positioning is conducted using a CCD camera, alignment marks formed in advance on the glass substrate 51, etc. before proceeding to a further process.

A different attraction method, using a blower, is disclosed in Japanese Laid-Open Patent Applications No. 8-324786/1996 (Tokukaihei 8-324786) and No. 7-33281/1995 (Tokukaihei 7-33281).

In addition, thin-type glass substrates and thin-type plastic substrates made of plastic having a thickness of 0.7 mm or less are employed in recent development for thinner and lighter liquid crystal display elements, and some of them are already available for commercial use. The aforementioned attracting method is used for those thin-type glass substrates and plastic substrates.

However, there are problems with the attracting methods for thin insulating substrates such as the glass substrates and plastic substrates above.

When the insulating substrate is fixed onto a stage by exerting vacuum attractive forces at attraction openings either simultaneously or with time shifts as disclosed in Japanese Laid-Open Patent Application No. 980404/1997 after lowering the lift pins and thus placing the insulating substrate on the stage, air is sucked between the insulating substrate and the stage through the attraction openings. The air flow generates static electricity and may cause the insulating substrate to slide on the stage as much as 1 cm.

Especially, the thin-type glass substrate and plastic substrate having a thickness of 0.7 mm or less, being lighter than glass substrates having a thickness exceeding 0.7 mm, exert less pressure on the stage and are more likely to be displaced.

Such movement of the insulating substrate may push the alignment marks out of the visible area for the CCD camera and the like, causing the CCD camera and the like to fail to recognize the alignment marks and to conduct highly precise positioning.

Moreover, if the thin-type glass substrate or plastic substrate is heated to remain at a temperature higher than room temperature while undergoing treatments in apparatuses or transported from one apparatus to another, irregular temperatures inside the apparatuses cause the substrate to have non-uniform temperature. The substrate consequently may warp, undulate, or bend entirely or partially.

Depending upon the treatment, the deformation may become of a perpetual nature or disappear after the treatment, which renders the substrate back into the flat shape. Sometimes, the substrate is deformed in various manners during a treatment. The extent, direction, and location of such deformation also may be perpetuated, disappear after the treatment, and vary constantly during the treatment. Even if the temperature inside the apparatus is consistent, the deformations happen while raising or lowering the temperature of the substrate before or after the treatment and conducting a series of treatments at different temperatures.

If that deformation happens, when the thin-type glass substrate or plastic substrate is fixed onto a stage by exerting vacuum attractive forces at attraction openings either simultaneously or with time shifts after lowering the lift pins and thus placing the substrate on the stage, the substrate cannot be attracted at the first instance. Otherwise, although being attracted at the first instance, the substrate may come off later as the attractive forces yield to the deformation of the substrate and cause the vacuum to break down.

Especially the thin-type glass substrate and plastic substrate are less rigid than glass substrates having the same size but a thickness exceeding 0.7 mm, the rigidity being less likely to overcome the deformation. Therefore, the thin-type glass substrate and plastic substrate are easier to deform and more difficult to attract.

In addition, the thin-type glass substrate and plastic substrate are lighter than glass substrates having the same size but a thickness exceeding 0.7 mm. If the warp exceeds a certain level (1 mm to 2 mm in a convex shape or in four directions for a substrate of about 300 mm×400 mm), the weight of the substrate cannot overcome the warp and render the substrate back into the flat shape, and the substrate therefore cannot be attracted onto the stage.

If the substrate is not attracted onto the stage, post-treatments such as alignment cannot be conducted.

Meanwhile, plastic substrates having a thickness of 0.4 mm or less and a plastic film having a thickness of 0.3 mm or less are even less rigid and susceptible to deformation and undulation even without being heated. This is a self-bending phenomena or so-called droop: when a part of the substrate is supported, the remaining part of the substrate, not supported, bends because the rigidity thereof yields to the weight thereof.

If the orientation state of the molecules of the material constituting the substrate or a physical or chemical property of the substrate in cross-sectional directions is not isotropic, the substrate undulates. This phenomena is called curling.

Depending upon the treatment, such as how the substrate is supported, the deformation may become of a perpetual nature or disappear after the treatment, which renders the substrate back into the flat shape. Sometimes, the substrate is deformed in various manners during a treatment.

If that deformation happens, when the plastic substrate is fixed onto a stage by exerting vacuum attractive forces at attraction openings either simultaneously or with time shifts after lowering the lift pins and thus placing the substrate on the stage, the substrate cannot be attracted at the first instance. Otherwise, although being attracted at the first instance, the substrate may come off later as the attractive forces yield to the deformation of the substrate and cause the vacuum to break down, and post-treatments such as alignment cannot be conducted.

If attractive force is to be exerted on the substrate susceptible to deformation, the attracting method using a blower is effective as disclosed in Japanese Laid-Open Patent Applications No. 8-324786/1996 and No. 7-33281/1995.

A blower is for generating an air flow by rotating blades. Air goes in one side and out the other. An object placed on the in-side is attracted to the blower: an electric cleaner is a good example.

The blower does not boast absolute attractive force as strong as a vacuum pump. However, the blower is versatile to deformations of an object, since the blower is capable of attracting the object even when the attraction opening is not completely closed by the object and thus free from vacuum breakdown.

However, if attractive forces are uniformly exerted across an entire deformed thin-type glass substrate or plastic substrate as in the arrangements disclosed in Japanese Laid-Open Patent Applications No. 8-324786/1996 and No. 7-33281/1995, the substrate may successfully be attracted onto the stage only in a deformed shape. Consequently, for example, a uniform orientation film cannot be applied in the orientation film printing treatment due to the deformation of the substrate, resulting in printing irregularities such as convexities and concavities in the finished state.

Moreover, in a rubbing treatment as an example, the rubbing cloth rubs the distorted part of the substrate excessively, leaving scratches on the orientation film or causing the substrate to split.

If a blower is used to exert attractive forces simultaneously across an entire thin plastic substrate having a thickness of 0.4 mm or less or across an entire plastic film having a thickness of 0.3 mm or less, the blower produces a similar result: the blower can successfully attract the substrate onto the stage only in a deformed shape. Consequently, the substrate may irrevocably be folded or split due to print pressure or rubbing pressure exerted on the substrate, for example, during orientation film printing and rubbing treatments.

SUMMARY OF THE INVENTION

In view of the problems, an object of the present invention is to offer manufacturing methods of liquid crystal display elements and manufacturing apparatuses of the same which attract and fix an insulating substrate on a stage without allowing the substrate to slide out of position, even when a thin-type glass substrate or a thin-type plastic substrate is used. Another object is to offer manufacturing methods of liquid crystal display elements and manufacturing apparatuses of the same which attract and fix an insulating substrate on a stage firmly and flatly by removing deformations of the substrate with substantially strong forces, even when a thin-type glass substrate or a thin-type plastic substrate is used.

In order to accomplish the objects, a first manufacturing apparatus of a liquid crystal display element in accordance with the present invention is a manufacturing apparatus of a liquid crystal display element by conducting various treatments on an insulating substrate, and includes:

- a support table having a flat support region in which the insulating substrate is placed;
- attraction openings provided in the support region and categorized into groups; and
- attractive force controller for exerting attractive forces on the insulating substrate at the attraction openings so as to fix the insulating substrate onto the support table, the attractive forces first being exerted at one of the groups which occupies the smallest area.

With the first manufacturing apparatus of a liquid crystal display element, the attractive force controller fixes the insulating substrate onto the support table by exerting the attractive forces on the insulating substrate placed in the flat support region on a support table, first at the attraction openings belonging to one of the groups which occupies the smallest area and subsequently at the attraction openings belonging to the other groups. By attracting and fixing the insulating film part by part in this manner, the air-flow-caused generation of static electricity can be restrained and the insulating substrate can be prevented from sliding, in comparison to a case where the whole insulating film is attracted and fixed simultaneously.

A first manufacturing method of a liquid crystal display element in accordance with the present invention is a manufacturing method of a liquid crystal display element by fixing an insulating substrate on a support table having a flat support region and conducting various treatments on the insulating substrate, and includes the steps of:

(1) placing the insulating substrate in the support region;

(2) exerting attractive forces on the insulating substrate at attraction openings provided in the support region and categorized into groups so as to fix the insulating substrate onto the support table; and (3) conducting various treatments on the insulating substrate, wherein, in the step (2), the attractive forces are first exerted at one of the groups which occupies the smallest area.

With the first manufacturing method of a liquid crystal display element, (1) the insulating substrate is placed in the flat support region on the support table, (2) the attractive forces are exerted first at the attraction openings belonging to one of the groups which occupies the smallest area and subsequently at the attraction openings belonging to the other groups, and (3) the various treatments are conducted on the insulating substrate. By attracting and fixing the insulating film part by part in this manner, the airflow-caused generation of static electricity can be restrained and the insulating substrate can be prevented from sliding, in comparison to a case where the whole insulating film is attracted and fixed simultaneously.

A second manufacturing apparatus of a liquid crystal display element in accordance with the present invention is a manufacturing apparatus of a liquid crystal display element by conducting various treatments on an insulating substrate, and includes:

a support table having a flat support region in which the insulating substrate is placed;

first attraction openings provided across the entire support region;

a second attraction opening provided in a vicinity of a circumference of the support region in such a manner to enclose the first attraction openings; and attractive force controller for exerting attractive forces on the insulating substrate at the first attraction openings and the second attraction opening so as to fix the insulating substrate onto the support table, the attractive force controller exerting the attractive forces independently with respect to the first attraction openings and the second attraction opening.

With the second manufacturing apparatus of a liquid crystal display element, the attractive force controller fixes the insulating substrate onto the support table by exerting the attractive forces on the insulating substrate placed in the flat support region on a support table at the first attraction openings provided across the entire support region and at the second attraction opening provided in the vicinity of the circumference of the support region in such a manner to enclose the first attraction openings, the attractive forces being exerted independently with respect to the first attraction openings and the second attraction opening. Therefore, when the insulating substrate is to be attracted and fixed, a closed system is created as if the vicinity of the circumference of the insulating substrate was sealed by an O-ring. This blocks air passage between the insulating substrate and the support table and surely attracts and fixes even an insulating substrate susceptible to distortion, which in turn prevents the insulating substrate from sliding and from coming off the support table during subsequent treatments.

A second manufacturing method of a liquid crystal display element in accordance with the present invention is a manufacturing method of a liquid crystal display element by fixing an insulating substrate on a support table having a flat support region and conducting various treatments on the insulating substrate, and includes the steps of:

(1) placing the insulating substrate in the support region;

(2) exerting attractive forces on the insulating substrate at first attraction openings provided across the entire support region and a second attraction opening provided in a vicinity of a circumference of the support region in such a manner to enclose the first attraction openings so as to fix the insulating substrate onto the support table, the attractive forces being exerted independently with respect to the first attraction openings and the second attraction opening; and (3) conducting various treatments on the insulating substrate.

With the second manufacturing method of a liquid crystal display element, (1) the insulating substrate is placed in the support region on the support table, (2) the attractive forces are exerted on the insulating substrate at the first attraction openings provided across the entire support region and at the second attraction opening provided in the vicinity of the circumference of the support region in such a manner to enclose the first attraction openings so as to fix the insulating substrate onto the support table, the attractive forces being exerted independently with respect to the first attraction openings and the second attraction opening, and (3) the various treatments are conducted on the insulating substrate. Therefore, when the insulating substrate is to be attracted and fixed, a closed system is created as if the vicinity of the circumference of the insulating substrate was sealed by an O-ring. This blocks air passage between the insulating substrate and the support table and surely attracts and fixes even an insulating substrate susceptible to distortion, which in turn prevents the insulating substrate from sliding and from coming off the support table during subsequent treatments.

For a fuller understanding of the nature and advantages of the invention, reference should be made to the ensuing detailed description taken in conjunction with the accompanying drawings.

DESCRIPTION OF THE EMBODIMENTS

[First Embodiment]

Figure 1:
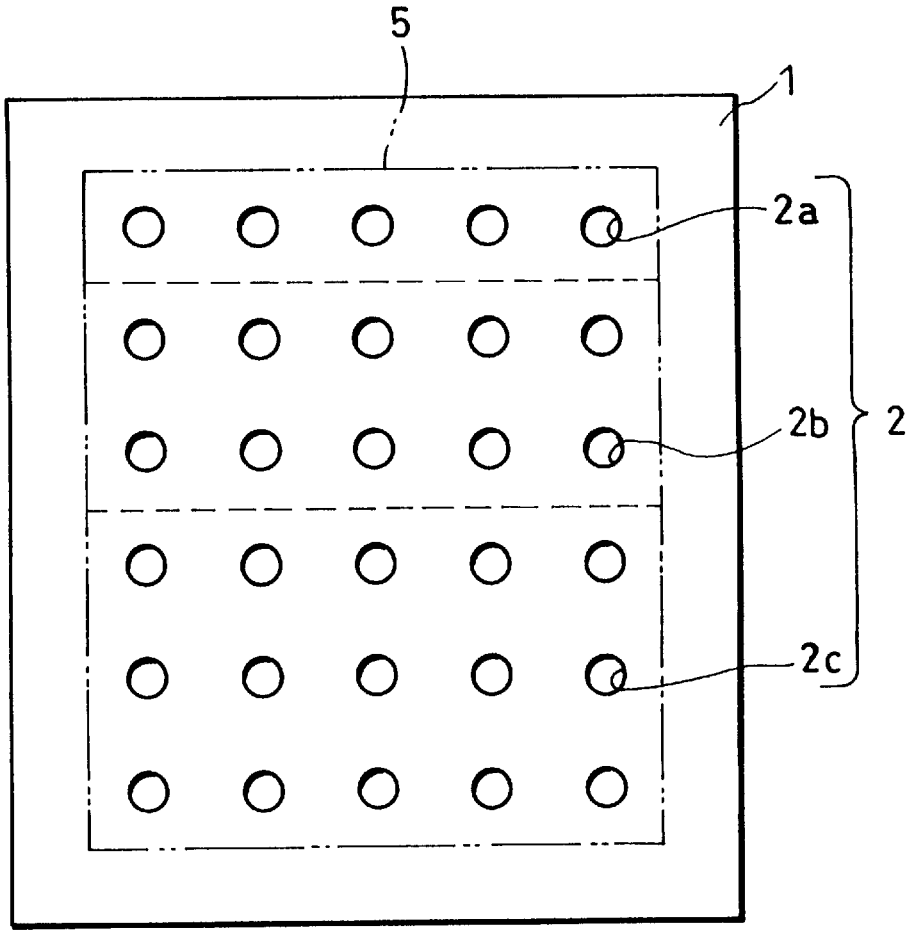
FIG. 1 is a plan view showing a stage and an insulating substrate of the first embodiment in accordance with the present invention.
Figure 2:
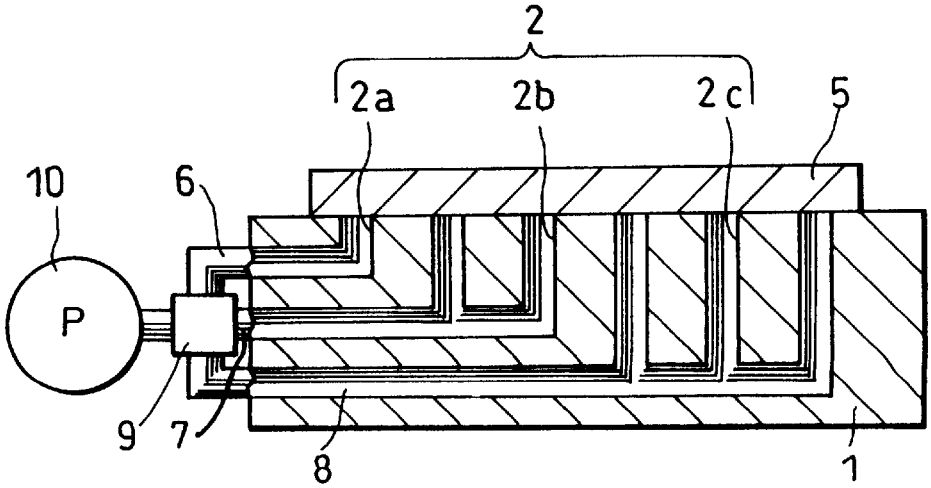
FIG. 2 is a cross-sectional view showing the stage and the insulating substrate of the first embodiment in accordance with the present invention.

Referring to FIGS. 1 and 2, the following description will discuss an embodiment in accordance with the present invention.

For example, a stage (support table) 1 having a flat support region thereon is provided to an orientation film printing apparatus used in a manufacturing process of a liquid crystal display element as shown in FIGS. 1 and 2.

The stage 1 has attraction openings 2 having a diameter of about 0.5 mm to 1.0 mm arrayed across the entire support region in a matrix form with intervals of about 5 mm to 30 mm.

The attraction openings 2 are categorized into the first group 2*a*, the second group 2*b*, and the third group 2*c*. The attraction openings of the first group 2*a* are connected to a first linking passage 6 provided inside the stage 1. The first linking passage 6 is then connected to a vacuum pump (attractive force control means) 10 via a switching valve 9. The attraction openings of the second group 2*b* are connected to a second linking passage 7 provided inside the stage 1 separately from the first linking passage 6. The second linking passage 7 is then connected to the vacuum pump 10 via the switching valve 9. The attraction openings of the third group 2*c* are connected to a third linking passage 8 provided inside the stage 1 separately from the first and second linking passages 6 and 7. The third linking passage 8 is then connected to the vacuum pump 10 via the switching valve 9.

The switching valve 9 switches between a state where the vacuum pump 10 operates to exert vacuum attractive forces at the attraction openings of the first group 2*a* through the first linking passage 6 (hereinafter will be referred to as the first attractive force exerting state), a state where the vacuum pump 10 operates to exert vacuum attractive forces at the attraction openings of the second group 2*b* through the second linking passage 7 as well as at the attraction openings of the first group 2*a* through the first linking passage 6 (hereinafter will be referred to as the second attractive force exerting state), and a state where the vacuum pump 10 operates to exert vacuum attractive forces at the attraction openings of the third group 2*c* through the third linking passage 8 as well as at the attraction openings of the first group 2*a* through the first linking passage 6 and at the attraction openings of the second group 2*b* through the second linking passage 7 (hereinafter will be referred to as the third attractive force exerting state).

Incidentally, although the present embodiment explains attraction openings categorized into three groups, the number of groups is not limited to three. Also, although the present embodiment explains a switching valve 9 switching between the attractive force exerting states, a vacuum pump 10 may be provided for each group.

A glass substrate or a flat plastic substrate made of plastic having a thickness of 0.7 mm or less, as an example, is attracted and fixed as an insulating substrate 5 by operations below, after being placed on the orientation film printing apparatus equipped with the stage 1.

First, the insulating substrate 5 is positioned properly in a cassette loaded with a plurality of insulating substrates 5 by means of positioning pins and the like and then placed on lift pins (not shown) standing on the stage 1 by a transport arm and the like.

Thereafter, the insulating substrate 5 is placed on the stage 1 by lowering the lift pins, and the switching valve 9 is manipulated to connect the first linking passage 6 to the vacuum pump 10, effecting the first attractive force exerting state. The insulating substrate 5 is hence attracted and fixed onto the stage 1 at the attraction openings of the first group 2*a* alone. Here, air is sucked between the insulating substrate 5 and the stage 1 through the attraction openings of the first group 2*a* alone, thereby restraining air-flow-caused generation of static electricity and reducing the risks of the insulating substrate 5 sliding.

Subsequently, the switching valve 9 is manipulated so as to maintain the connection of the first linking passage 6 to the vacuum pump 10 and to newly connect the second linking passage 7 to the vacuum pump 10, effecting the second attractive force exerting state. The insulating substrate 5 is hence attracted and fixed onto the stage 1 at the attraction openings of the first group 2*a* and the attraction openings of the second group 2*b*. Here, air is sucked between the insulating substrate 5 and the stage 1 through the attraction openings of the second group 2*b* alone, thereby restraining air-flow-caused generation of static electricity. In addition, the insulating substrate 5 is already attracted and fixed onto the stage 1 at the attraction openings of the first group 2*a*, preventing the insulating substrate 5 from sliding.

Next, the switching valve 9 is manipulated so as to maintain the connection of the first linking passage 6 to the vacuum pump 10 and of the second linking passage 7 to the vacuum pump 10 and to newly connect the third linking passage 8 to the vacuum pump 10, effecting the third attractive force exerting state. The insulating substrate 5 is hence attracted and firmly fixed onto the stage 1 at the attraction openings of the first group 2*a*, at the attraction openings of the second group 2*b*, and at the attraction openings of the third group 2*c*. Here, air is sucked between the insulating substrate 5 and the stage 1 through the attraction openings of the third group 2*c* alone, thereby restraining air-flow-caused generation of static electricity. In addition, the insulating substrate 5 is already attracted and fixed onto the stage 1 at the attraction openings of the first group 2*a* and at the attraction openings of the second group 2*b*, preventing the insulating substrate 5 from sliding.

Thereafter, highly precise positioning is conducted using a CCD camera, alignment marks formed in advance on the insulating substrate 5, etc. before printing an orientation film. After the treatments by the apparatus are finished, the switching valve 9 is manipulated to release the attraction and fixation, and the insulating substrate 5 is transported out of the apparatus for a further process.

Incidentally, although the present embodiment explains an orientation film printing apparatus, the present invention is applicable to a resist applying apparatus, an exposure apparatus, a seal printing apparatus, etc. and still produces similar advantages.

[Second Embodiment]

Figure 3:
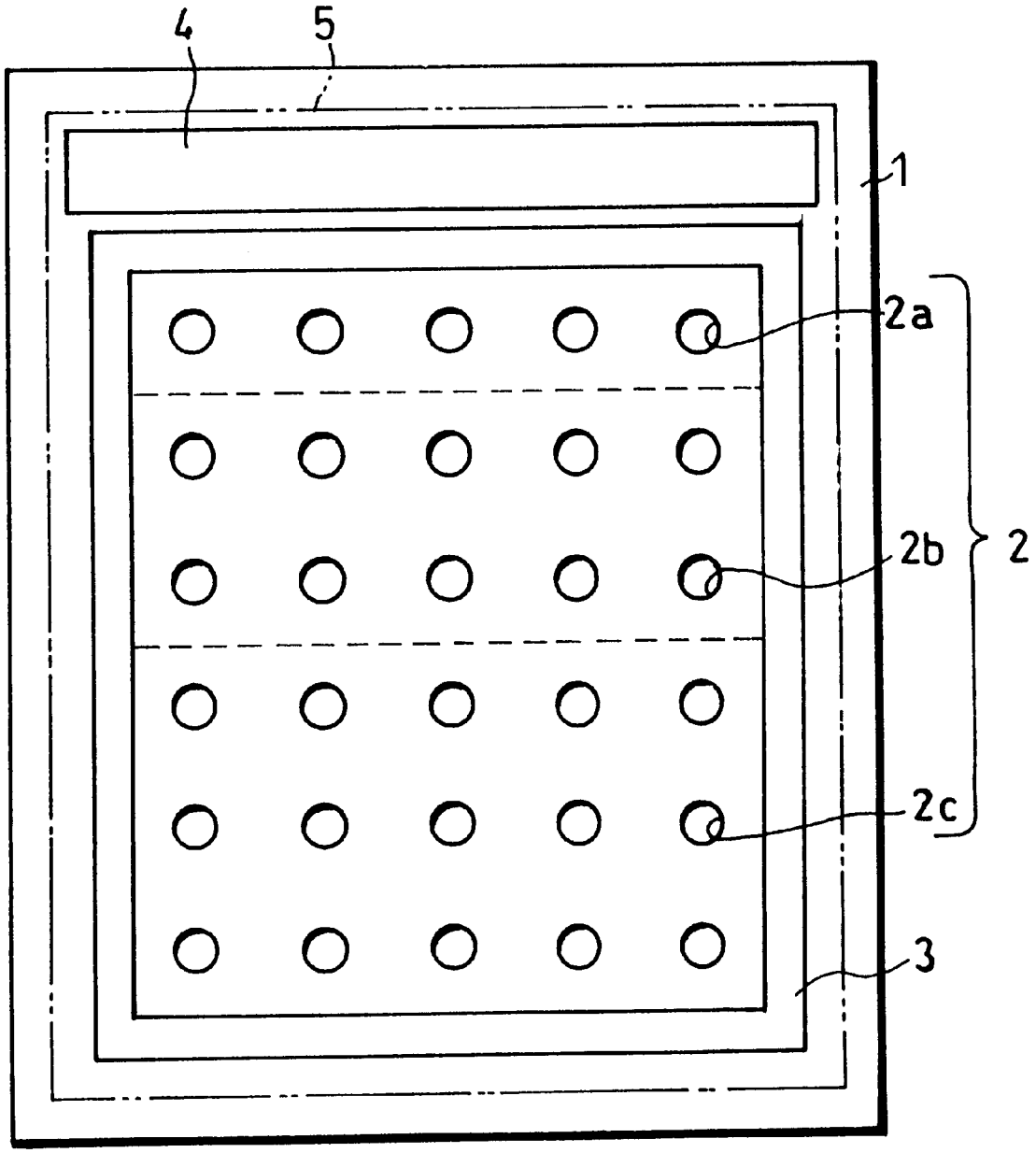
FIG. 3 is a plan view showing a stage and an insulating substrate of the second embodiment in accordance with the present invention.
Figure 4:
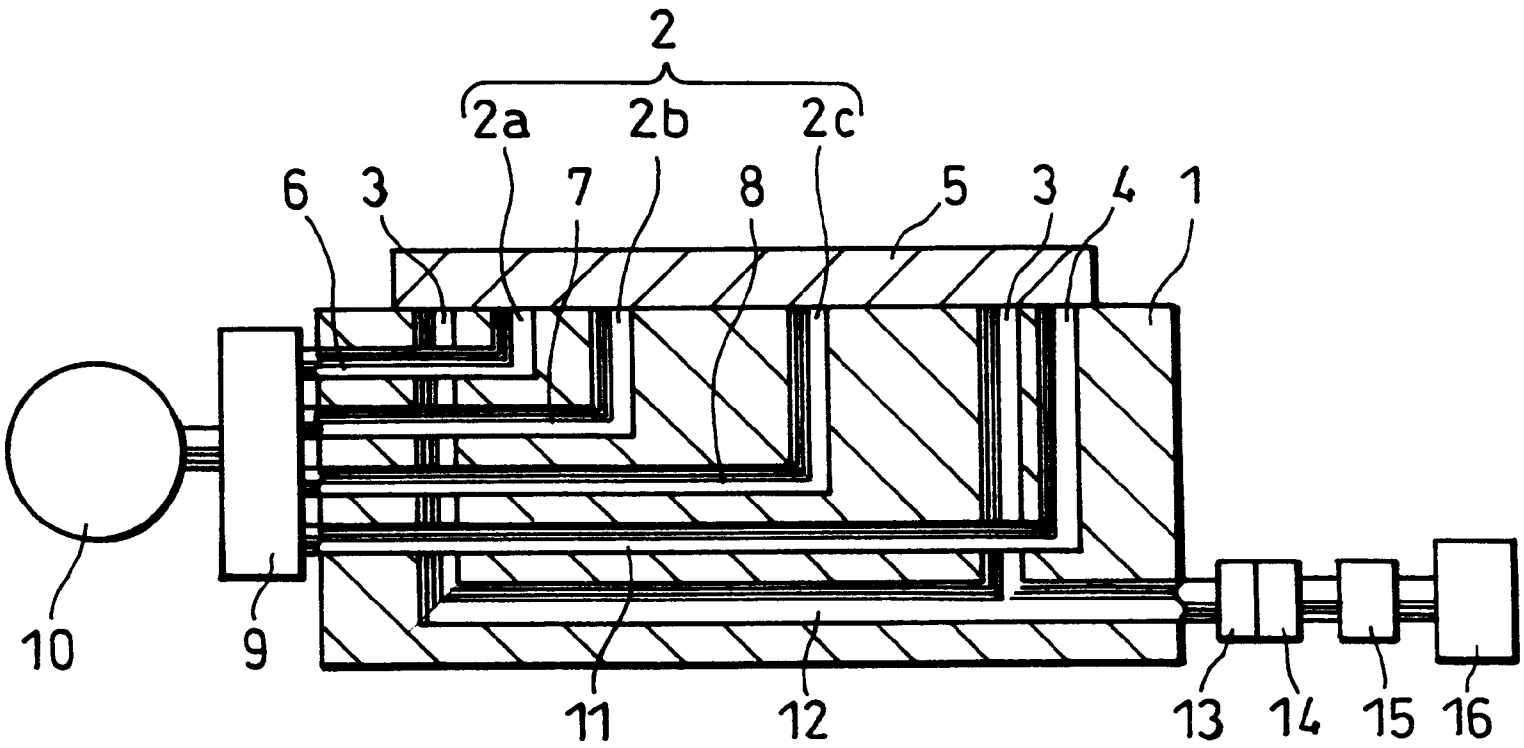
FIG. 4 is a cross-sectional view showing the stage and the insulating substrate of the second embodiment in accordance with the present invention, in which a pipe of a blower is connected.
Figure 5:
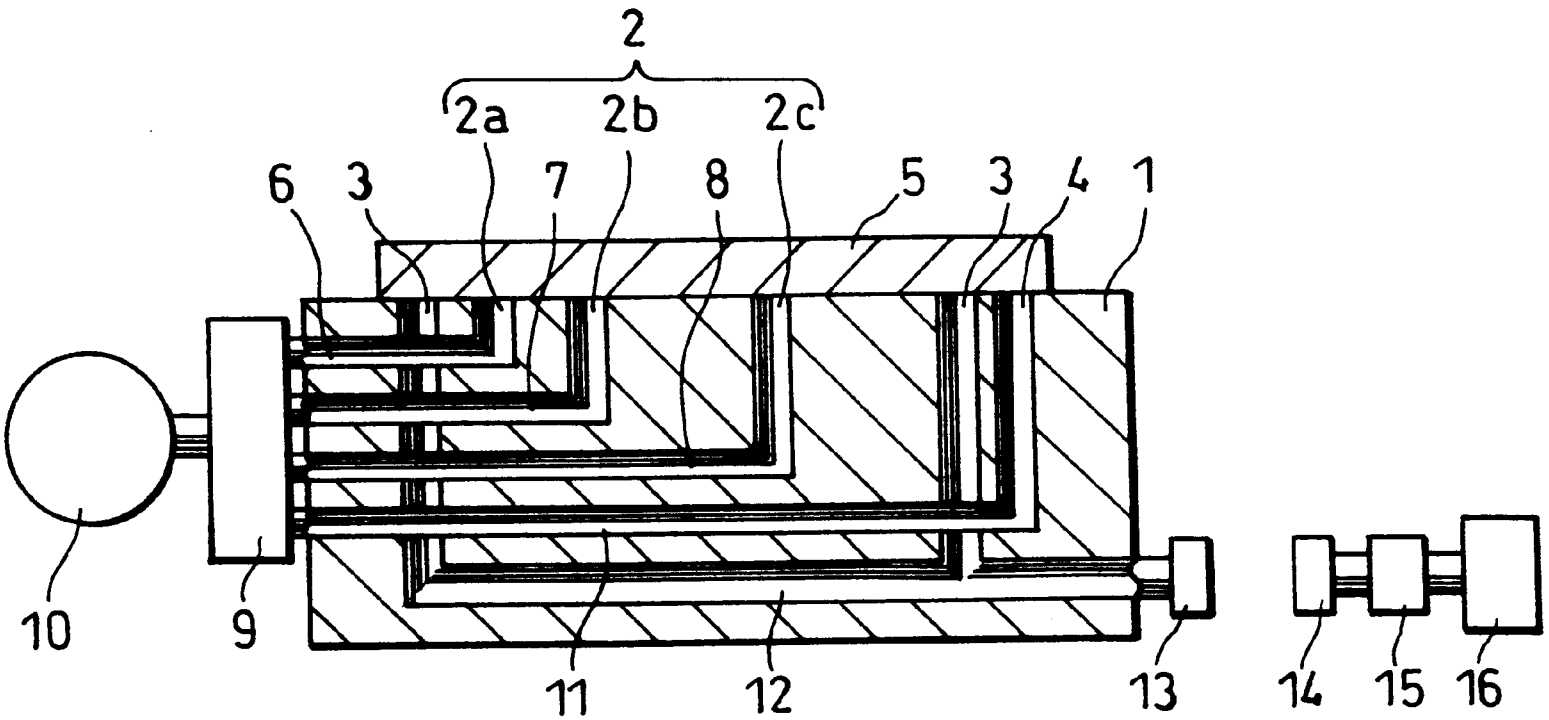
FIG. 5 is a cross-sectional view showing the stage and the insulating substrate of the second embodiment in accordance with the present invention, in which the pipe of the blower is disconnected.
Figure 6:
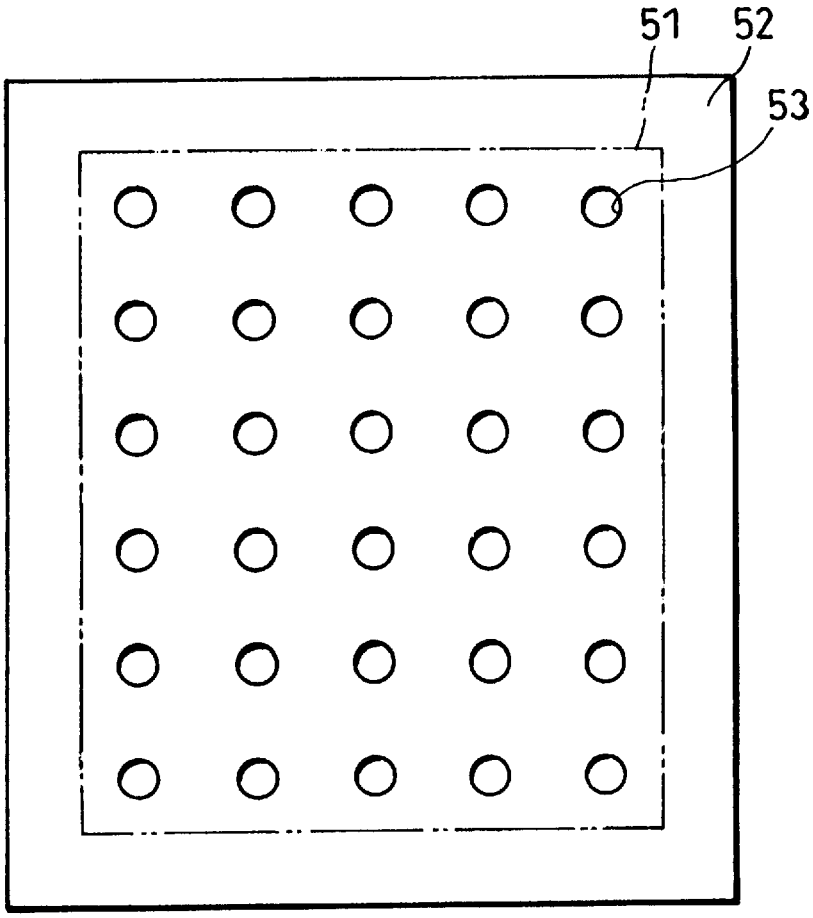
FIG. 6 (PRIOR ART)
FIG. 6 is a plan view showing a conventional stage and a glass substrate placed on the stage.
Figure 7:
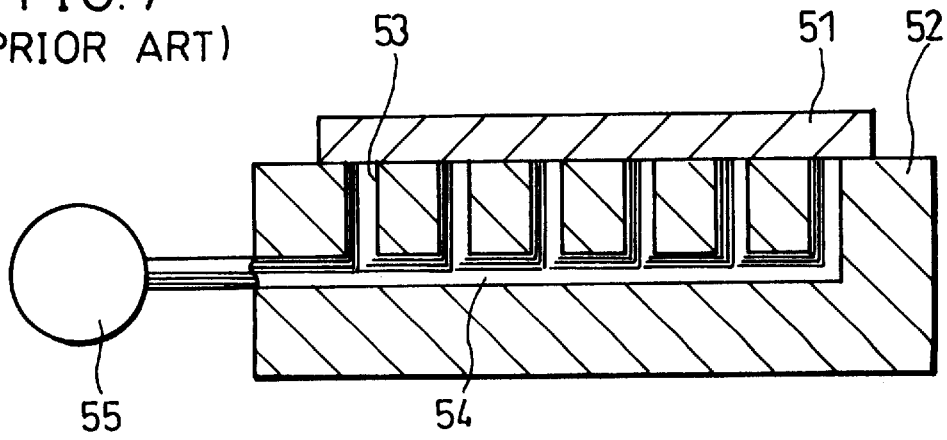
FIG. 7 (PRIOR ART)
FIG. 7 is a cross-sectional view showing the conventional stage and the glass substrate placed on the stage.

Referring to FIGS. 3 through 5, the following description will discuss an embodiment in accordance with the present invention.

For example, a stage (support table) 1 having a flat support region thereon is provided to an orientation film printing apparatus used in a manufacturing process of a liquid crystal display element as shown in FIGS. 3 through 5. The stage 1 has first attraction openings 2 having a diameter of about 0.5 mm to 1.0 mm arrayed across the entire support region in a matrix form with intervals of about 5 mm to 30 mm.

In the present embodiment, the first attraction openings 2 are categorized into 3 groups including the first group 2*a*, the second group 2*b*, and the third group 2*c*. The first attraction openings 2 are preferably categorized into two or more groups.

In addition, a second attraction opening 3 is provided in a strip shape having a width of 1.0 mm to 2.0 mm to enclose the first attraction openings 2. As to the configuration of the second attraction opening 3, attraction openings having a diameter of about 0.5 mm to 1.0 mm may be arrayed to form about 2 to 5 lines enclosing the first attraction openings 2.

Moreover, a third attraction opening 4 may be provided in a strip shape having a width of 2.0 mm outside the second attraction opening 3. As to the configuration of the third attraction opening 4, attraction openings having a diameter of about 0.5 mm to 1.0 mm may be arrayed to form about 2 to 5 lines. The position of the third attraction opening 4 is preferably determined to correspond to the position where a letterpress provided on a printing roller first touches the insulating substrate 5 to start printing.

The first attraction openings of the first group 2*a*, the first attraction openings of the second group 2*b*, and the first attraction openings of the third group 2*c* into which the first attraction openings 2 are categorized are connected to an elastic first linking passage 6, an elastic second linking passage 7, and an elastic third linking passage 8 respectively. The first, second, and third linking passages 6, 7, and 8 are provided inside the stage 1 and connected to a vacuum pump 10 via a switching valve 9.

Similarly, the third attraction opening 4 is connected to an elastic fourth linking passage 11 provided inside the stage 1, the fourth linking passage 11 being connected to the vacuum pump 10 via the switching valve 9.

The switching valve 9 is capable of independently switching between a state where the vacuum pump 10 operates to exert vacuum attractive forces at the first attraction openings of the first group 2*a* through the first linking passage 6, a state where the vacuum pump 10 operates to exert vacuum attractive forces at the first attraction openings of the second group 2*b* through the second linking passage 7, a state where the vacuum pump 10 operates to exert vacuum attractive forces at the first attraction openings of the third group 2*c* through the third linking passage 8, and a state where the vacuum pump 10 operates to exert vacuum attractive forces at the third attraction opening 4 through the fourth linking passage 11.

The switching valve 9 is capable of switching to effect any one of those states and also any combination of those states. The switching valve 9 is also capable of switching to effect the states with a time shift.

The second attraction opening 3 is connected to a fifth linking passage 12 provided inside the stage 1, and the fifth linking passage 12 is connected to a blower 16 via a valve 15 and first and second connecting and disconnecting sections 13 and 14. The first and second connecting and disconnecting sections 13 and 14 can be attached and detached mutually according to the movement of the stage 1.

An insulating substrate 5 made of a plastic substrate or a thin-type glass substrate having a thickness of 0.7 mm or less, as an example, is attracted and fixed by operations below, after being placed on the orientation film printing apparatus equipped with the stage 1.

First, the insulating substrate 5 is positioned properly in a cassette loaded with a plurality of insulating substrates 5 by means of positioning pins and the like and then placed on lift pins (not shown) standing on the stage 1 by a transport arm and the like.

Thereafter, the insulating substrate 5 is placed on the stage 1 by lowering the lift pins, and the valve 15 of the blower 16 which has been operating is turned on to exert attractive forces on the insulating substrate 5 at the second attraction opening 3.

Air is sucked between the insulating substrate 5 and the stage 1 quickly, restraining air-flow-caused generation of static electricity. In addition, a distorted substrate 5 can be attracted and thus fixed in a vicinity of the circumference thereof by the strong attractive force of the blower 16.

Subsequently, the vacuum pump 10 operates in conjunction with the switching valve 9 to exert attractive forces at the first attraction openings of the first group 2*a* on the insulating substrate 5 in a vicinity of the circumference thereof. Next, the switching valve 9 is manipulated to exert attractive forces on nearly a half of the insulating substrate 5 at the first attraction openings of the first group 2*a* and the first attraction openings of the second group 2*b*. Then, the switching valve 9 is manipulated to exert attractive forces on nearly the entire insulating substrate 5 at the first attraction openings of the first group 2*a*, the first attraction openings of the second group 2*b*, and the first attraction openings of the third group 2*c*.

Since when the vacuum pump 10 exerts the attractive forces on the insulating substrate 5 at the first attraction openings 2, the insulating substrate 5 is already attracted and thus fixed in the vicinity of the circumference thereof, there is no outward passage for air between the insulating substrate 5 and the stage 1. The insulating substrate 5, even when distorted, can thereby be attracted and thus fixed surely with a vacuum attraction method. The insulating substrate 5 neither slides during subsequent treatments nor comes off from the stage 1.

Moreover, by exerting the attractive forces at the first attraction openings 2, specifically, first at the first attraction openings of the first group 2*a*, then at the first attraction openings of the second group 2*b*, and finally at the first attraction openings of the third group 2*c*, distortions of the insulating substrate 5 are squeezed out of the region where the insulating substrate 5 is already attracted towards the region where the insulating substrate 5 is yet to be attracted, allowing the insulating substrate 5 to be attracted flatly without distortion.

The distortions are gradually squeezed to the non-attracted region and eventually accumulated in the vicinity of the circumference of the insulating substrate 5. The valve 15 of the blower 16 is turned off at that timing and thus releases the attractive forces exerted at the second attraction opening 3 on the insulating substrate 5 in the vicinity of the circumference thereof, effectively removing the distortion of the insulating substrate 5.

After releasing the attractive forces exerted at the second attraction opening 3, the switching valve 9 is preferably manipulated so that the vacuum pump 10 exerts attractive forces on the insulating substrate 5 at the third attraction opening 4.

As mentioned earlier, if the position of the third attraction opening 4 is determined to correspond to the position where a letterpress provided on a printing roller first touches the insulating substrate 5 to start printing, the part most susceptible to vacuum breakdown is firmly attracted and thus fixed, preventing vacuum breakdown from happening during printing.

After attracting and thus fixing the insulating substrate 5 in this manner, highly precise positioning is conducted using a CCD camera, alignment marks formed in advance on the insulating substrate 5, etc.

Next, the stage 1 moves to a printing position where an orientation film is printed. The first and second connecting and disconnecting sections 13 and 14 are detached according to the movement of the stage 1 as shown in FIG. 5.

Since the insulating substrate 5 is attracted and thus fixed onto the stage 1 flatly despite the releasing of the attractive forces exerted at the second attraction opening 3, the attractive forces exerted at the first attraction openings 2 and the third attraction opening 4 alone are strong enough to keep the insulating substrate 5 attracted and fixed firmly and to avoid the insulating substrate 5 from coming off during treatments.

Next, after an orientation film is printed on the insulating substrate 5, the stage 1 acts as a transport mechanism on its own. As the stage 1 transports the insulating substrate 5 to a position where the insulating substrate 5 is ejected for a next step, the switching valve 9 is manipulated to release the attractive forces exerted on the insulating substrate 5 at the first attraction openings 2 and the third attraction opening 4, and the insulating substrate 5 is ejected from the apparatus for a next step.

Here, the elastic first, second, third, and fourth linking passages 6, 7, 8, and 11 to which the vacuum pump is connected follow the movement of the stage 1 as they stretch and contract.

Incidentally, although the present embodiment explains an orientation film printing apparatus, the present invention is applicable to a resist applying apparatus, an exposure apparatus, a spacer dispersion apparatus, a seal printing apparatus, a transport mechanism in those apparatuses for introduction or ejection, etc. and still produces similar advantages.

A first manufacturing method of a liquid crystal display element in accordance with the present invention is a manufacturing method of a liquid crystal display element by exerting attractive forces on an insulating substrate at attraction openings, thus fixing the insulating substrate onto a support table having a flat support surface in which the attraction openings are provided, and conducting various treatments on the insulating substrate, and is characterized in that the insulating substrate is divided into at least two domains, the attractive forces are exerted on the insulating substrate at the attraction openings with a time shift for each of the domains to fix the insulating substrate, and subsequently the various treatments are conducted on the insulating substrate.

With the first manufacturing method of a liquid crystal display element in accordance with the present invention, the insulating substrate is divided into at least two domains, the attractive forces are exerted on the insulating substrate at the attraction openings with a time shift for each of the domains to fix the insulating substrate, and subsequently the various treatments are conducted on the insulating substrate. Thereby, the amount of static electricity generated can be reduced in every domain in comparison to a case where the whole insulating film is attracted and fixed simultaneously. Consequently, the insulating substrate can be prevented from sliding when it is to be attracted and fixed.

In addition, the first manufacturing method of a liquid crystal display element in accordance with the present invention, incorporating the features of the manufacturing method of a liquid crystal display element laid out as above, is preferably arranged so that the time shift starts with one end of the insulating substrate and moves towards the opposite end.

By exerting the attractive forces with the time shift starting with one end of the insulating substrate and moving towards the opposite end, air is sucked and thus removed between the insulating substrate and the support table efficiently, and the insulating substrate therefore can be better prevented from sliding when the insulating substrate is to be attracted and fixed. This is because if it takes a long time to suck and thus remove air between the insulating substrate and the support table, the amount of static electricity generated increases all the more, and the insulating substrate is more likely to slide out of position.

In addition, the first manufacturing method of a liquid crystal display element in accordance with the present invention, incorporating the features of the manufacturing method of a liquid crystal display element laid out as above, is preferably arranged so that the domain at which the attractive forces are exerted first is the smallest of the domains.

By first exerting the attractive forces on the insulating substrate at the smallest of the domains, the amount of static electricity generated in the domain at which the attractive forces are first exerted on the insulating substrate can be rendered the smallest, and the insulating substrate therefore can be better prevented from sliding when the insulating substrate is to be attracted and fixed. With the arrangement, since the domain at which the attractive forces are first exerted on the insulating substrate is already attracted and fixed, even if the amount of static electricity generated in the domains at which the attractive forces are exerted subsequently is large, the insulating substrate does not slide.

In addition, the first manufacturing method of a liquid crystal display element in accordance with the present invention, incorporating the features of the manufacturing method of a liquid crystal display element laid out as above, can prevent the insulating substrate from sliding when the insulating substrate is to be attracted and fixed onto the support table, even if the insulating substrate is made of glass having a thickness of 0.7 mm or less.

In addition, the first manufacturing method of a liquid crystal display element in accordance with the present invention, incorporating the features of the manufacturing method of a liquid crystal display element laid out as above, can prevent the insulating substrate from sliding when the insulating substrate is to be attracted and fixed onto the support table, even if the insulating substrate is made of plastic.

A first manufacturing apparatus of a liquid crystal display element in accordance with the present invention is a manufacturing apparatus of a liquid crystal display element, including a support table having a flat support surface on which an insulating substrate is placed and attraction openings provided in the support surface, for fixing the insulating substrate by exerting attractive forces at the attraction openings and for conducting various treatments on the insulating substrate, and is characterized in that the insulating substrate is divided into at least two domains, and a mechanism is included for exerting the attractive forces on the insulating substrate at the attraction openings with a time shift for each of the domains.

With the first manufacturing apparatus of a liquid crystal display element in accordance with the present invention, the insulating substrate is divided into at least two domains, and the mechanism is included for exerting the attractive forces on the insulating substrate at the attraction openings with a time shift for each of the domains. Thereby, the amount of static electricity generated can be reduced in every domain in comparison to a case where the whole insulating film is attracted and fixed simultaneously. Consequently, the insulating substrate can be prevented from sliding when it is to be attracted and fixed.

In addition, the first manufacturing apparatus of a liquid crystal display element in accordance with the present invention, incorporating the features of the manufacturing method of a liquid crystal display element laid out as above, is preferably arranged so that the time shift starts with one end of the insulating substrate and moves towards the opposite end.

By exerting the attractive forces with the time shift starting with one end of the insulating substrate and moving towards the opposite end, air is sucked and thus removed between the insulating substrate and the support table efficiently, and the insulating substrate therefore can be better prevented from sliding when the insulating substrate is to be attracted and fixed. This is because if it takes a long time to suck and thus remove air between the insulating substrate and the support table, the amount of static electricity generated increases all the more, and the insulating substrate is more likely to slide out of position.

In addition, the first manufacturing apparatus of a liquid crystal display element in accordance with the present invention, incorporating the features of the manufacturing method of a liquid crystal display element laid out as above, is preferably arranged so that the domain at which the attractive forces are exerted first is the smallest of the domains.

By first exerting the attractive forces on the insulating substrate at the smallest of the domains, the amount of static electricity generated in the domain at which the attractive forces are first exerted on the insulating substrate can be rendered the smallest, and the insulating substrate therefore can be better prevented from sliding when insulating substrate is to be attracted and fixed. With the arrangement, since the domain at which the attractive forces are first exerted on the insulating substrate is already attracted and fixed, even if the amount of static electricity generated in the domains at which the attractive forces are exerted subsequently is large, the insulating substrate does not slide.

A second manufacturing method of a liquid crystal display element in accordance with the present invention is a manufacturing method of a liquid crystal display element by exerting attractive forces on an insulating substrate at attraction openings, thus fixing the insulating substrate onto a support table having a flat support surface in which the attraction openings are provided, and conducting various treatments on the insulating substrate, and is characterized in that the attractive forces are exerted on the insulating substrate at first attraction openings for attracting and thus fixing a central part of the insulating substrate and at a second attraction opening for attracting and thus fixing a vicinity of a circumference of the insulating substrate in such a manner to enclose the first attraction openings so as to fix the insulating substrate onto the support table, and the various treatments are conducted on the insulating substrate.

With the second manufacturing method of a liquid crystal display element in accordance with the present invention, by exerting the attractive forces on the insulating substrate at the first attraction openings for attracting and thus fixing the central part of the insulating substrate and at the second attraction opening for attracting and thus fixing the vicinity of the circumference of the insulating substrate in such a manner to enclose the first attraction openings, a closed system is created as if the vicinity of the circumference of the insulating substrate was sealed by an O-ring. This blocks air passage between the insulating substrate and the support table and surely attracts and fixes the central part of even an insulating substrate susceptible to distortion, which in turn prevents the insulating substrate from sliding and from coming off the support table during subsequent treatments.

In addition, the second manufacturing method of a liquid crystal display element in accordance with the present invention, incorporating the features of the manufacturing method of a liquid crystal display element laid out as above, is preferably arranged so that the attractive forces are exerted at the second attraction opening using a blower.

By the blower exerting the attractive forces at the second attraction opening when the insulating substrate is to be attracted and fixed onto the support table, even if static electricity is generated by the air flow between the insulating substrate and the support table, the attraction technique using the blower creating a large air flow sucks air before a significant amount of static electricity is generated, and thus greatly reduces the amount of static electricity generated. Consequently, the insulating substrate therefore can be prevented from sliding when it is to be attracted and fixed.

Moreover, since the attraction technique using the blower is employed for attracting in absolute flow quantity, when the insulating substrate is placed on the support table, even if a part of the attraction opening is not covered by the insulating substrate due to distortion of the insulating substrate, vacuum breakdown does not happen, and the attraction does not break.

In addition, the second manufacturing method of a liquid crystal display element in accordance with the present invention, incorporating the features of the manufacturing method of a liquid crystal display element laid out as above, is preferably arranged so that the attractive forces are exerted first at the second attraction opening and thereafter at the first attraction openings.

By exerting the attractive forces first at the second attraction opening and thereafter at the first attraction openings, the aforementioned closed system can be formed first, allowing air to be sucked between the insulating substrate and the support table efficiently and in the shortest time possible. Moreover, the shorter time of air flow contributes to a reduction of the amount of static electricity generated, further preventing the insulating substrate from sliding out of position when the insulating substrate is to be attracted and fixed.

In addition, the second manufacturing method of a liquid crystal display element in accordance with the present invention, incorporating the features of the manufacturing method of a liquid crystal display element laid out as above, is preferably arranged so that the first attraction openings are grouped among at least two domains, and the attractive forces are exerted on the insulating substrate with a time shift for each of the domains.

By grouping the first attraction openings among at least two domains and exerting the attractive forces on the insulating substrate with a time shift for each of the domains, even if the insulating substrate is distorted, the insulating substrate is attracted and fixed gradually domain by domain, the distortions are gradually squeezed towards a domain where the insulating substrate is yet to be attracted and fixed, and eventually accumulated in a vicinity of the circumference. Therefore, the central part of the insulating substrate can be flatly attracted and fixed onto the support table.

In addition, the second manufacturing method of a liquid crystal display element in accordance with the present invention, incorporating the features of the manufacturing method of a liquid crystal display element laid out as above, is preferably arranged so that after exerting the attractive forces at the first attraction openings, the attractive forces are released at the second attraction opening, and the various treatments are conducted on the insulating substrate.

By exerting the attractive forces at the first attraction openings and thereafter releasing the attractive forces at the second attraction opening and conducting the various treatments on the insulating substrate, the distortions accumulated in the vicinity of the circumference are almost completely removed by releasing the attractive forces at the second attraction opening, and the insulating substrate can be flatly attracted and fixed onto the support table.

In addition, the second manufacturing method of a liquid crystal display element in accordance with the present invention, incorporating the features of the manufacturing method of a liquid crystal display element laid out as above, is preferably arranged so that a third attraction opening for attracting and fixing an edge of insulating substrate is provided outside the second attraction opening.

By providing the third attraction opening for attracting and fixing the edge of the insulating substrate outside the second attraction opening, even if the distortions remain along the edge of the insulating substrate, the attractive forces can be exerted at the third attraction opening to attract and fix the insulating substrate onto the support table flatly across the entire insulating substrate including at the edge thereof.

In addition, the second manufacturing method of a liquid crystal display element in accordance with the present invention, incorporating the features of the manufacturing method of a liquid crystal display element laid out as above, is preferably arranged so that when an orientation film is printed, the third attraction opening is provided to correspond to a position where a letterpress provided on a printing roller first touches the insulating substrate.

By providing the third attraction opening so as to correspond to a position where the letterpress provided on the printing roller first touches the insulating substrate when an orientation film is printed, the part most susceptible to vacuum breakdown is firmly attracted and thus fixed, preventing vacuum breakdown from happening during printing.

In addition, the second manufacturing method of a liquid crystal display element in accordance with the present invention, incorporating the features of the manufacturing method of a liquid crystal display element laid out as above, is preferably arranged so that after exerting the attractive forces at the second attraction opening and at the first attraction openings, the attractive forces are released at the second attraction opening, the attractive forces are exerted at the third attraction opening, and the various treatments are conducted on the insulating substrate.

By exerting the attractive forces at the second attraction opening and at the first attraction openings and thereafter releasing the attractive forces at the second attraction opening, exerting the attractive forces at the third attraction opening, and conducing the various treatments on the insulating substrate, the distortions of the insulating substrate are accumulated in the circumference and removed, allowing the insulating substrate to be attracted and fixed onto the support table flatly across the entire insulating substrate including at the edge thereof.

In addition, the second manufacturing method of a liquid crystal display element in accordance with the present invention, incorporating the features of the manufacturing method of a liquid crystal display element laid out as above, can prevent the insulating substrate from sliding when the insulating substrate is to be attracted and fixed onto the support table, even if the insulating substrate is made of plastic.

In addition, the second manufacturing method of a liquid crystal display element in accordance with the present invention, incorporating the features of the manufacturing method of a liquid crystal display element laid out as above, can prevent the insulating substrate from sliding when the insulating substrate is to be attracted and fixed onto the support table, even if the insulating substrate is made of glass having a thickness of 0.7 mm or less.

A second manufacturing apparatus of a liquid crystal display element in accordance with the present invention is a manufacturing apparatus of a liquid crystal display element, including a support table having a flat support surface on which an insulating substrate is placed and attraction openings provided in the support surface, for fixing the insulating substrate by exerting attractive forces at the attraction openings and for conducting various treatments on the insulating substrate, and is characterized in that first attraction openings for attracting and thus fixing a central part of the insulating substrate and a second attraction opening for attracting and thus fixing a vicinity of a circumference of the insulating substrate in such a manner to enclose the first attraction openings are included.

With the second manufacturing apparatus of a liquid crystal display element in accordance with the present invention, by including the first attraction openings for attracting and thus fixing a central part of the insulating substrate and the second attraction opening for attracting and thus fixing the vicinity of the circumference of the insulating substrate in such a manner to enclose the first attraction openings, a closed system is created as if the vicinity of the circumference of the insulating substrate was sealed by an O-ring. This blocks air passage between the insulating substrate and the support table and surely attracts and fixes the central part of even an insulating substrate susceptible to distortion, which in turn prevents the insulating substrate from sliding and from coming off the support table during subsequent treatments.

In addition, the second manufacturing apparatus of a liquid crystal display element in accordance with the present invention, incorporating the features of the manufacturing apparatus of a liquid crystal display element laid out as above, is preferably arranged so that the attractive forces are exerted at the second attraction opening using a blower.

By the blower exerting the attractive forces at the second attraction opening when the insulating substrate is to be attracted and fixed onto the support table, even if static electricity is generated by the air flow between the insulating substrate and the support table, the attraction technique using the blower creating a large air flow sucks air before a significant amount of static electricity is generated, and thus greatly reduces the amount of static electricity generated. Consequently, the insulating substrate therefore can be prevented from sliding when it is to be attracted and fixed.

Moreover, since the attraction technique using the blower is employed for attracting in absolute flow quantity, when the insulating substrate is placed on the support table, even if a part of the attraction opening is not covered by the insulating substrate due to distortion of the insulating substrate, vacuum breakdown does not happen, and the attraction does not break.

In addition, the second manufacturing apparatus of a liquid crystal display element in accordance with the present invention, incorporating the features of the manufacturing apparatus of a liquid crystal display element laid out as above, is preferably arranged so that a connecting and disconnecting mechanism is included in a pipe between the blower and the second attraction opening.

By including a connecting and disconnecting mechanism in a pipe between the blower and the second attraction opening, there is no need to lay a pipe covering a long distance with consideration to the movement of the support table during subsequent treatments following the attraction and fixation.

In addition, the second manufacturing apparatus of a liquid crystal display element in accordance with the present invention, incorporating the features of the manufacturing apparatus of a liquid crystal display element laid out as above, is preferably arranged so that the first attraction openings are grouped among at least two domains, and the attractive forces are exerted on the insulating substrate with a time shift for each of the domains.

By grouping the first attraction openings among at least two domains and exerting the attractive forces on the insulating substrate with a time shift for each of the domains, even if the insulating substrate is distorted, the insulating substrate is attracted and fixed gradually domain by domain, the distortions are gradually squeezed towards a domain where the insulating substrate is yet to be attracted and fixed, and eventually accumulated in a vicinity of the circumference. Therefore, the central part of the insulating substrate can be flatly attracted and fixed onto the support table.

In addition, the second manufacturing apparatus of a liquid crystal display element in accordance with the present invention, incorporating the features of the manufacturing apparatus of a liquid crystal display element laid out as above, is preferably arranged so that the attractive forces exerted at the first attraction openings and those exerted at the second attraction opening can be controlled mutually independently.

By controlling the attractive forces exerted at the first attraction openings and those exerted at the second attraction opening mutually independently, the distortions accumulated in the vicinity of the circumference are almost completely removed by releasing the attractive forces at the second attraction opening, and the insulating substrate can be flatly attracted and fixed onto the support table.

In addition, the second manufacturing apparatus of a liquid crystal display element in accordance with the present invention, incorporating the features of the manufacturing apparatus of a liquid crystal display element laid out as above, is preferably arranged so that a third attraction opening for attracting and fixing an edge of insulating substrate is provided outside the second attraction opening.

By providing the third attraction opening for attracting and fixing the edge of the insulating substrate outside the second attraction opening, even if the distortions remain along the edge of the insulating substrate, the attractive forces can be exerted at the third attraction opening to attract and fix the insulating substrate onto the support table flatly across the entire insulating substrate including at the edge thereof.

In addition, the second manufacturing apparatus of a liquid crystal display element in accordance with the present invention, incorporating the features of the manufacturing apparatus of a liquid crystal display element laid out as above, is preferably arranged so that when the second manufacturing apparatus is used as an orientation film printing apparatus, the third attraction opening is provided to correspond to a position where a letterpress provided on a printing roller first touches the insulating substrate.

By providing the third attraction opening so as to correspond to a position where the letterpress provided on the printing roller first touches the insulating substrate when the second manufacturing apparatus is used as an orientation film printing apparatus, the part most susceptible to vacuum breakdown is firmly attracted and thus fixed, preventing vacuum breakdown from happening during printing.

In addition, the second manufacturing apparatus of a liquid crystal display element in accordance with the present invention, incorporating the features of the manufacturing apparatus of a liquid crystal display element laid out as above, is preferably arranged so that the attractive forces exerted at the first attraction openings, those exerted at the second attraction opening, and those exerted at the third attraction opening can be controlled mutually independently.

By controlling the attractive forces exerted at the first attraction openings, those exerted at the second attraction opening, and those exerted at the third attraction opening mutually independently, the distortions of the insulating substrate are accumulated in the circumference and removed, allowing the insulating substrate to be attracted and fixed onto the support table flatly across the entire insulating substrate including at the edge thereof.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A manufacturing apparatus for a liquid crystal display element formed on an insulating substrate by conducting various treatments on the insulating substrate, comp rising:

a support table having a flat support region in which the insulating substrate is placed;

attraction openings provided in the support region and categorized into groups; and attractive force controller for exerting attractive forces on the insulating substrate at the attraction openings so as to fix the insulating substrate onto the support table, the attractive forces first being exerted at one of the groups which occupies the smallest area; wherein the groups are arrayed parallel to each other, and the attractive force controller exerts the attractive forces at the groups in order from a group on one end to a group on an opposite end.

2. The manufacturing apparatus as defined in claim 1, wherein the attractive force controller means includes a vacuum pump and a switching valve.

3. The manufacturing apparatus as defined in claim 1, further including said insulating substrate on said flat region of said support table, wherein the insulating substrate is made of glass having a thickness of 0.7 mm or less.

4. The manufacturing apparatus as defined in claim 1, further including said insulating substrate on said flat region of said support table, wherein the insulating substrate is made of plastic.

5. A manufacturing apparatus for a liquid crystal display element formed on an insulating substrate by conducting various treatments on the insulating substrate, comprising:

a support table having a flat support region in which the insulating substrate is placed;

first attraction openings provided across the entire support region;

a second attraction opening for directly attracting and fixing a vicinity of a circumference of the insulating substrate, said second attraction opening being provided in the support region in such a manner to enclose the first attraction openings; and attractive force controller for exerting attractive forces on the insulating substrate at the first attraction openings and the second attraction opening so as to fix the insulating substrate onto the support table, the attractive force controller exerting the attractive forces independently with respect to the first attraction openings and the second attraction opening;

wherein the attractive force controller includes:

first attractive force controller for exerting the attractive forces at the first attraction openings; and second attractive force controller for exerting the attractive forces at the second attraction opening;

wherein the first attraction openings are categorized into groups, and the attractive force controller exerts the attractive forces independently with respect to each group of the first attraction openings;

wherein the groups are arrayed parallel to each other, and the attractive force controller exerts the attractive forces at the groups in order from a group on one end to a group on an opposite end.

6. A manufacturing apparatus for a liquid crystal display element formed on an insulating substrate by conducting various treatments on the insulating substrate, comprising:

a support table having a flat support region in which the insulating substrate is placed;

first attraction openings provided across the entire support region;

a second attraction opening for directly attracting and fixing a vicinity of a circumference of the insulating substrate, said second attraction opening being provided in the support region in such a manner to enclose the first attraction openings; and attractive force controller for exerting attractive forces on the insulating substrate at the first attraction openings and the second attraction opening so as to fix the insulating substrate onto the support table, the attractive force controller exerting the attractive forces independently with respect to the first attraction openings and the second attraction opening;

further comprising a third attraction opening provided further outside the second attraction opening in a vicinity of a circumference of the support region, wherein the attractive force controller exerts the attractive forces on the insulating substrate at the first attraction openings, the second attraction opening, and the third attraction opening, the attractive force controller exerting the attractive forces independently with respect to the first attraction openings, the second attraction opening, and the third attraction opening.

7. The manufacturing apparatus as defined in claim 6, being used as an orientation film printing apparatus, wherein the third attraction opening is provided to correspond to a position where a letterpress provided on a printing roller first touches the insulating substrate.

8. The manufacturing apparatus as defined in claim 7, further including said insulating substrate on said flat region of said support table, wherein the insulating substrate is made of glass having a thickness of 0.7 mm or less.

9. The manufacturing apparatus as defined in claim 7, further including said insulating substrate on said flat region of said support table, wherein the insulating substrate is made of plastic.

* * * * *